US006728990B1

(12) United States Patent
Jones

(10) Patent No.: US 6,728,990 B1
(45) Date of Patent: May 4, 2004

(54) MOP CONTAINER

(76) Inventor: Alma M. Jones, RR 5 133541, Flesherton, Ontario (CA), N0C 1E0

( * ) Notice: Subject to any disclaimer, the term of this patent is extended or adjusted under 35 U.S.C. 154(b) by 303 days.

(21) Appl. No.: 09/899,462

(22) Filed: Jul. 5, 2001

(51) Int. Cl.[7] ..... A47L 13/14

(52) U.S. Cl. ..... 15/260; 15/264; 220/669; 206/209; 206/361

(58) Field of Search ..... 15/260, 264, 263, 15/DIG. 9, 257.05, 257.07, 257.074, 257.076; 220/669, 672, 675; 206/361–362.4, 209

(56) References Cited

U.S. PATENT DOCUMENTS

| | | | | | |
|---|---|---|---|---|---|
| 473,025 | A | * | 4/1892 | Seward | 401/122 |
| 713,827 | A | | 11/1902 | Winn | |
| 816,793 | A | * | 4/1906 | Harris | 206/209 |
| 1,512,744 | A | | 10/1924 | Calder | |
| 1,553,023 | A | * | 9/1925 | Bonnell | 15/264 |
| 2,149,255 | A | | 3/1939 | Fader | |
| 2,255,091 | A | | 9/1941 | Vaughn | |
| 2,738,531 | A | | 3/1956 | Gerosa | |
| 2,787,015 | A | | 4/1957 | Flam | |
| 2,835,246 | A | * | 5/1958 | Boettger | 600/570 |
| 3,383,732 | A | | 5/1968 | James et al. | |
| 4,738,355 | A | * | 4/1988 | Jobe | 206/5.1 |
| 4,903,848 | A | | 2/1990 | Chattman | |
| 5,022,559 | A | * | 6/1991 | Condon | 222/109 |
| 5,071,060 | A | * | 12/1991 | DeFelice | 229/403 |
| 5,199,130 | A | | 4/1993 | Lazar | |
| 5,455,980 | A | | 10/1995 | Buchanan | |
| D400,789 | S | * | 11/1998 | Rupert | D9/347 |
| 6,248,085 | B1 | * | 6/2001 | Scholz et al. | 604/2 |

* cited by examiner

*Primary Examiner*—Gary K. Graham
(74) *Attorney, Agent, or Firm*—Malin, Haley & DiMaggio, P.A.

(57) ABSTRACT

A mop receptacle for use with dish mops and floor mops which allows the user to strain the excess cleaning solution from the mop head without contacting the mop head or actuating any levers or other mechanicals. The receptacle is substantially cylindrical in shape with a tapered wall section which compresses the mop head as it passes through straining any excess cleaning solution from the mop head. The smooth inside walls leading to the tapered wall section can also be used to drain cleaning solution from the mop head by pressing the head against the walls via the mop handle forcing the mop head to compress further.

6 Claims, 2 Drawing Sheets

MOP CONTAINER

BACKGROUND OF THE INVENTION

1. Field of the Invention

The present invention relates to mop cleaning aids and more specifically to a mop and mop receiving, straining and wringing receptacles.

2. Description of Related Art

Conventional mops are used to clean various types of surfaces with a cleaning solution. A typical mop is comprised of a mop head made of coarse yarn, sponge or other absorbent material attached to a handle.

During use, a mop is held by the user while wiping a surface. A cleaning solution is applied by dipping the mop head in a liquid cleaning solution. Any excess cleaning solution is forced from the mop head by wringing or compressing the mop head. After the excess cleaning solution has been removed so that the mop does not drip or leak cleaning solution upon unwanted areas, the handle is used to manipulate the mop head so that the mop head wipes and cleans the intended surface area. After surface wiping, the mop is again dipped into the cleaning solution to remove any dirt absorbed and excess cleaning solution is forced from the mop head by wringing or compressing the mop head. These steps are repeated until the solution needs to be changed due to excess exposure to dirt from the mop head or until finished cleaning.

One shortcoming of the mopping process is the wringing or compressing step. Typically, the user utilizes a wringing device which attempts to remove the excess cleaning solution from the mop head. These devices are inefficient. Conventional wringing or compressing devices are attached to a solution containing receptacle such as a bucket by either hanging over the edge of the receptacle or contained within the receptacle. Those mop head compressing devices that hang over the edge of the receptacle often require the user to use the handle of the mop to exert force on the mop head and the compressing device so that excess cleaning fluid is removed. This off center force may cause the receptacle to which the compressing device is attached to fall over due to the unbalanced force applied. Other off-center compressing devices that hang over the edge of the receptacle require the user to push or pull a lever; these devices may also cause the receptacle to tip over. Compressing devices can be a cumbersome attachment to a bucket due to the size of compressor necessitated by the mop head size. Other wringing devices which are contained within the receptacle can also cause the receptacle to tip over in use because of off set forces required for operation. These type devices also require the use of a larger receptacle since the mop compressor occupies space within the receptacle.

Some mops incorporate a wringing device. These type mops require the user to pull or push a lever attached to the handle of the mop that causes device mechanicals to strain or wring the mop head thereby removing excess cleaning solution. These mops often cause the user's hands to contact cleaning solution because of the proximity of the lever to the mop head. Additionally these mops are cumbersome because of the mechanicals attached to the mop head and are often more difficult to store.

Dish mops are commonly used to clean dishes in the same way that a regular mop is used to clean the floor. Additionally, dish mops are also used for cleaning countertops, cabinets, sinks, stove tops, windows, automobile dashboards and other surfaces. Since a dish mop is normally handled using one hand and due to its convenient compact size—straining and wringing or compressing devices are limited. Usually the user will manually compress excess cleaning solution from the mop head by hand using a sink or bucket to receive the solution removed.

It is therefore to the effective resolution of the aforementioned problems and shortcomings that the present invention is directed.

BRIEF SUMMARY OF THE INVENTION

A mop receptacle for use with hand dish mops or floor mops which allows the user to drain excess cleaning solution from the mop head without having to pull or push a lever, or contact the mop head.

The receptacle is substantially cylindrical, open at one end and having a flat bottom and thus closed at the opposite end, having a tapered wall section located medially between the open end and closed end.

The open end of the receptacle is preferably circular and of sufficient size in diameter to allow a mop head to easily enter without obstruction. The receptacle sits very stable on a level horizontal flat surface such as the floor being cleaned or a counter top.

The user fills the receptacle with a desired cleaning solution so that the solution level does not rise above the tapered wall section. The user then inserts and submerges the mop head into the cleaning solution contained by the receptacle. When the mop head encounters the tapered wall section upon entering or exiting the receptacle, the mop head is compressed and excess cleaning solution contained within the mop head is removed. The inside diameter of the receptacle is slowly reduced at the tapered wall section so that the receptacle resembles an hour glass near the tapered wall section. This tapered inner body allows the mop head to pass through the tapered wall section smoothly with minimal effort. Additionally, the user may press the mop head against the inside surface of the receptacle leading to the tapered wall section to remove any additional cleaning solution if desired. The cleaning solution level in the receptacle is below the tapered wall section.

The receptacle may be sized to accommodate a floor mop or a dish mop. A handle or bail may be incorporated to make the receptacle easy to manipulate and transport. A cover may be provided so that the receptacle may be stored with cleaning solution contained within without fear of being spilled.

The mop head may be made of coarse yarn or other suitable absorbent material and sized in diameter to fit into the open end of the receptacle and sized to be compressed upon passing through tapered wall section. Additionally, the mop head may be sized so that the mop head does not contact the cleaning solution within the receptacle while within or above the tapered wall section.

Additionally, in a receptacle sized for dish mops a hook or other hanging means located on the lid or receptacle may be incorporated for hanging the dish mop when not in use.

It is an object of this invention to provide a mop receptacle that can also function as a mop compressor.

In accordance with these and other objects which will become apparent hereinafter, the instant invention will now be described with particular reference to the accompanying drawings.

DETAILED DESCRIPTION OF THE INVENTION

Figure 1:
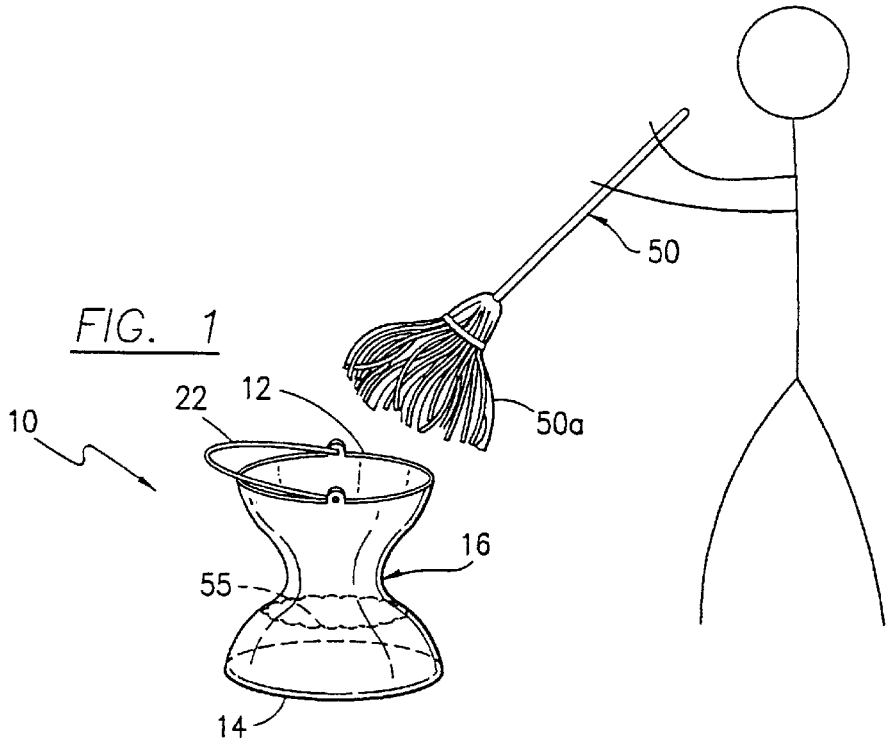
FIG. 1 is a perspective view of the preferred embodiment of the invention.
Figure 2:
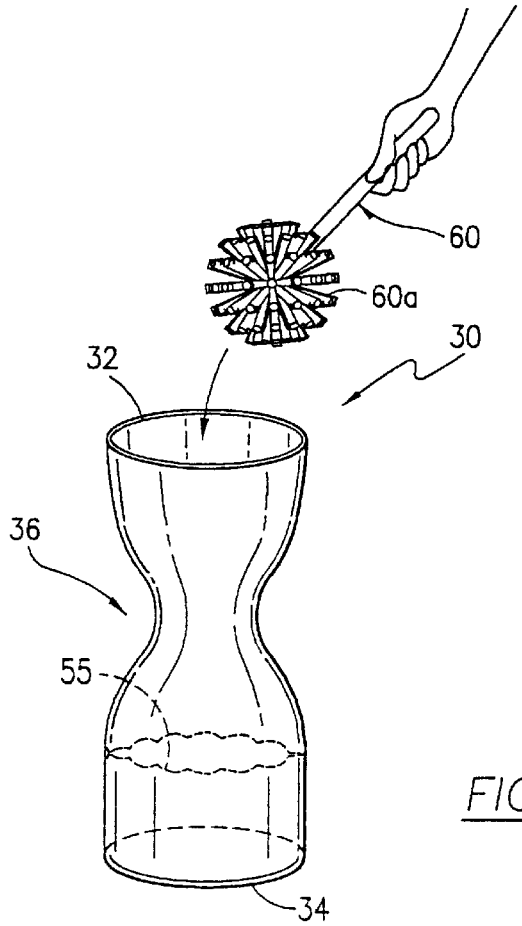
FIG. 2 is a perspective view of a second embodiment of the invention.
Figure 3:
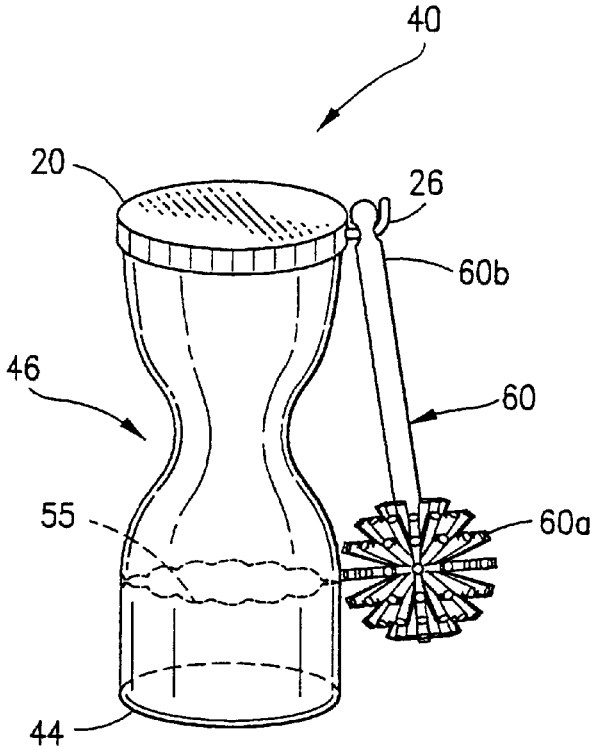
FIG. 3 is a perspective view of a third embodiment of the invention with a lid installed.

Referring now to FIG. 1, the preferred embodiment of the receptacle 10 is shown. Receptacle 10 is a substantially cylindrically shaped body having an open end 12, closed end 14, and tapered wall section 16. Receptacle 10 can be sized for use with a dish mop 60 (as seen in FIGS. 2 and 3) as well as with a floor mop 50 as seen in FIG. 1. Open end 12 is sized in diameter to accommodate a floor mop head 50*a* having a diameter between 6 inches and 20 inches though such should not be considered limiting. Closed end 14 forms a flat bottom which rests on the floor or other flat horizontal surface and may also have a diameter between 6 inches and 20 inches though such should not be considered limiting. A tapered wall section 16 is located substantially medial to open end 12 and closed end 14 with a diameter reduced to between 3 and 15 inches depending on the size of the floor mop head 50*a* being utilized though such should not be considered limiting. Tapered wall section 16 is smaller in diameter than open end 12 or closed end 14 so that a mop head 50*a* passing through the smaller inner diameter of tapered wall section 16 is compressed so that excess cleaning solution contained within mop head 50*a* is removed. Accordingly the height of receptacle 10 allows sufficient cleaning solution 55 to be contained within receptacle 10 without requiring a level of cleaning solution 55 higher than tapered wall section 16. For example, for a floor mop 50 with a mop head 50*a* which measures 12 inches in diameter, receptacle 10 may have an open end 12 measuring 16 inches in diameter, closed end 14 measuring 16 inches in diameter and a tapered wall section 16 reduced to 8 inches in diameter with the overall height of receptacle 10 being 17 inches. The diameter of the receptacle is slowly reduced at the tapered wall section 16 so that the receptacle resembles an hour glass near tapered wall section 16, this allows a mop head 50*a* to pass through the tapered wall section smoothly and with minimal effort. A handle 22 may also be provided pivotally attached to open end 12 to aid in carrying and moving the receptacle.

Referring now to FIG. 2, a second embodiment of the invention. Receptacle 30 is shown sized for a dish mop 60 and can be grasped by the average human hand. Receptacle 30 is substantially cylindrical having an open end 32 sized to accommodate dish mop head 60*a*. Closed end 34 rests on a horizontal countertop or any other flat surface. Open end 32 and closed end 34 may have a diameter between 3 inches and 8 inches though such should not be considered limiting. Similarly, tapered wall section 36 is smaller in diameter than open end 32 and closed end 34 so that dish mop head 60*a* passing through is compressed so that excess cleaning solution contained within mop head 60*a* is removed. The diameter of receptacle 30 is slowly reduced at the tapered wall section 36 so that the receptacle resembles an hour glass near tapered wall section 36. This allows dish mop head 60*a* to pass through tapered wall section 36 smoothly and with minimal effort. The diameter of tapered wall section 36 may be reduced to between 2 inches and 5 inches depending on the size of the dish mop head 60*a* being utilized. For example, for a dish mop 60 with a mop head 60*a* which measures 3.5 inches in diameter, receptacle 30 may have an open end 32 measuring 4.5 inches in diameter, closed end 34 measuring 4.5 inches in diameter and a tapered wall section 36 reduced to 2.5 inches in diameter with the overall height of receptacle 30 being 10 inches. Tapered wall section 36 also allows those users with smaller than average hands to easily grasp the receptacle by providing a smaller more easily grasped area.

Figure 4:
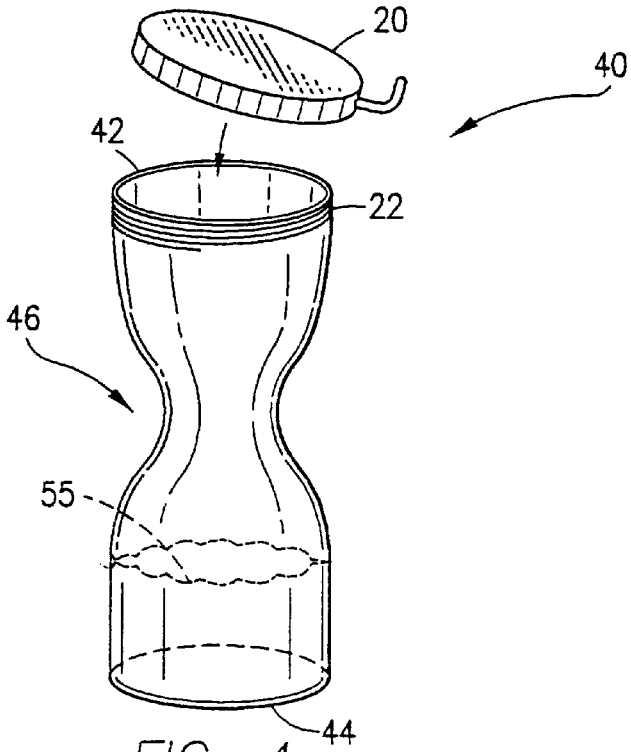
FIG. 4 is a perspective view of a third embodiment of the invention.

Referring to FIG. 4 there is shown a third embodiment of the invention, Receptacle 40 is shown sized for a dish mop 60 as described above and can be grasped by the average human hand. Receptacle 40 is substantially cylindrical having a threaded open end 42 with receptacle threads 22, closed end 44 and tapered wall section 46. A lid 20 is provided with lid threads for engaging receptacle threads 22. Lid 20 may close open end 42 by engaging those threads at open end 42 providing a sealed container as seen in FIG. 3.

Additionally, on receptacles 30 and 40 sized for use with dish mop 60, a prong 26 may be incorporated along the outer surface of the receptacle or along the outer edge of lid 20 (as seen in FIGS. 3 and 4) provided for engaging handle 60*b* of dish mop 60 and allowing it to hang at the side of the receptacle when not in use (as seen in FIG. 3).

Receptacles 10, 30 and 40 may be made of a clear or opaque water proof material such as plastic, glass, rubber, metal or wood. Lid 20 may be made of a clear or opaque waterproof material such as plastic, rubber, metal or wood. Floor mop head 50*a* and dish mop head 60*a* may be constructed of coarse yarn, sponge or other suitable absorbent material.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An improved mop container and mop combination of hand held miniature dish mop or full sized floor mop size, said combination comprising:

a mop having a compressible resilient water absorbent mop head body and a predetermined body lateral diameter;

a substantially cylindrical waterproof receptacle having an open end defined by a perimeter, closed end and a waterproof tapered wall section of reduced internal diameter and external diameter, said receptacle having a substantially circular cross section from end to end, said receptacle open end of perimeter sufficient size in diameter to allow the mop head body of said mop to conveniently enter the receptacle without contacting the receptacle open end perimeter, said receptacle having a flat exterior closed surface to rest securely on a flat surface with said closed end, said tapered wall section located substantially medially between said receptacle open end and said closed end, said tapered wall section being smaller in diameter than said mop head body and than said receptacle open or closed ends, the circumference of said receptacle gradually decreasing at said tapered wall section, said tapered wall section sized to compress said mop head body when forced through said tapered wall section, but to allow contact with a liquid in said receptacle below said tapered wall section.

2. The combination in claim 1 wherein said receptacle is sized for use with hand held dish mops and easily grasped by one hand of an average adult human user, said receptacle having a diameter between 3 inches and 8 inches at the open end perimeter and closed end, said tapered wall internal section having a diameter between 2 inches and 5 inches, said mop head body being less in diameter than said receptacle perimeter perimeter diameter.

3. The combination in claim 2 having a lid, said open end of said receptacle having receptacle threads, said lid having lid threads for engaging said receptacle threads.

4. The combination in claim 3 wherein said lid having a prong adapted to engage a dish mop handle for storage purposes.

5. The combination in claim 1 wherein said receptacle is sized for use with floor mops, said receptacle perimeter having a diameter between 6 inches and 20 inches at the open end and closed end, said tapered wall section having a diameter between 3 inches and 16 inches, said mop head body diameter being less than said receptacle perimeter.

6. The combination in claim 3 having a handle pivotally attached to said open end.

* * * * *